US009340323B1

(12) United States Patent
Tate

(10) Patent No.: US 9,340,323 B1
(45) Date of Patent: May 17, 2016

(54) PROTECTION OF GLASS BOTTLE

(71) Applicant: Wayne Tate, Ojai, CA (US)

(72) Inventor: Wayne Tate, Ojai, CA (US)

( * ) Notice: Subject to any disclaimer, the term of this patent is extended or adjusted under 35 U.S.C. 154(b) by 0 days.

(21) Appl. No.: 14/120,213

(22) Filed: May 7, 2014

Related U.S. Application Data

(63) Continuation-in-part of application No. 13/135,241, filed on Jun. 29, 2011.

(51) Int. Cl.
*B65D 23/12* (2006.01)
*B65D 23/00* (2006.01)

(52) U.S. Cl.
CPC ..... *B65D 23/001* (2013.01)

(58) Field of Classification Search
CPC ..... B65D 23/0885; B65D 23/001
USPC ..... 220/230
See application file for complete search history.

(56) References Cited

U.S. PATENT DOCUMENTS

| | | | | |
|---|---|---|---|---|
| 1,468,808 | A * | 9/1923 | Hamilton | 215/12.1 |
| 3,092,277 | A * | 6/1963 | Brim | 215/12.1 |
| 4,708,254 | A * | 11/1987 | Byrns | 215/13.1 |
| 4,823,974 | A * | 4/1989 | Crosser | 62/457.3 |
| 8,251,212 | B2 * | 8/2012 | Dunlap | 206/403 |
| 2003/0234201 | A1 * | 12/2003 | Shah et al. | 206/521 |
| 2005/0167390 | A1 * | 8/2005 | Dubs et al. | 215/274 |

* cited by examiner

*Primary Examiner* — Fenn Mathew
*Assistant Examiner* — Don M Anderson
(74) *Attorney, Agent, or Firm* — William W. Haefliger

(57) ABSTRACT

A high strength bottle and cover assembly comprising glass bottle, a synthetic resin cover extending closely about the bottle, the cover defining an irregular inner surface characterized in that surface deflection occurs upon impact with an external surface, preventing shattering of the glass, the bottle having a glass neck, a closure for said neck including a cylindrical glass lid engaging the neck, the closure including a synthetic resin cap endwise supporting the glass lid, the cap having a skirt extending about the lid and radially spaced therefrom, there being magnetic elements positioned for holding sections defined by the cover closed about the bottle.

14 Claims, 6 Drawing Sheets

PROTECTION OF GLASS BOTTLE

This application is a continuation-in-part of pending U.S. application Ser. No. 13/135,241, filed Jun. 29, 2011.

BACKGROUND OF THE INVENTION

This invention relates generally to protection of glass bottles or containers, and more particularly concerns provision of impact resistant covers for glass bottles or containers, protecting against glass shattering as during impact.

There is need for such protection of glass bottles or containers. Plastic water bottles have been found to be unsatisfactory for containing drinking water due to health hazards resulting from toxic chemical leaking from the plastic composition into the bottle water Metallic bottles are also unsatisfactory for retaining drinking water. Glass bottles themselves are superior to plastic and metallic bottles, but the breakable nature of glass bottles, as upon impact, remains a problem.

There is need for a highly protective, moldable plastic covers or coatings for glass bottles, that will satisfactorily protect the glass upon impact.

SUMMARY OF THE INVENTION

It is a major object of the invention to provide an improved high strength protective cover assembly for a bottle, that includes:

a) a glass bottle, b) a synthetic resin cover extending closely about the bottle, the cover defining an irregular inner surface characterized in that surface deflection occurs upon impact with an external surface, preventing shattering of the glass, c) the bottle having a glass neck, d) a closure for said neck including a cylindrical glass lid engaging the neck, e) said closure including a synthetic resin cap endwise supporting said glass lid, the cap having a skirt extending about the lid and radially spaced therefrom, f) there being magnetic elements positioned for holding sections defined by the cover closed about the bottle, and in alignment with the closure.

It is another object of the invention to provide magnetic element edges located in mutual proximity for magnetic attraction. As will be seen, the sections may typically define pockets into which the magnetic elements are received to extend in flush relation to surfaces defined by the sections. Also, the magnetic elements are spaced from the cap allowing the cover sections to spread apart upon impact, while the cap continues to position the upper ends of the cover sections relative to the bottle neck.

Further Objects Include:

i) provision of cover inner surface protrusions that are distributed substantially uniformly over the majority of the cover inner surface, j) provision of a bottle glass neck that forms a port, the stopper having an external surface, with glass to glass sealing interengagement with said neck, and the cover extending into proximity to said neck, the closure fitting over the bottle neck, and removably and downwardly engaging said cover, k) provision of a cover impact deflecting top extending over the end of the cap and over spacing formed between the top skirt and glass lid.

These and other objects and advantages of the invention, as well as the details of an illustrative embodiment, will be more fully understood from the following specification and drawings, in which:

DRAWING DESCRIPTION

Figure 7:
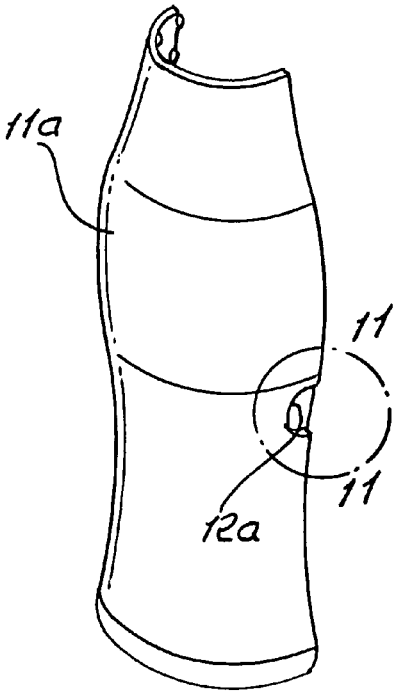
FIG. 7 is a perspective external view of a bottle cover section.
Figure 9:
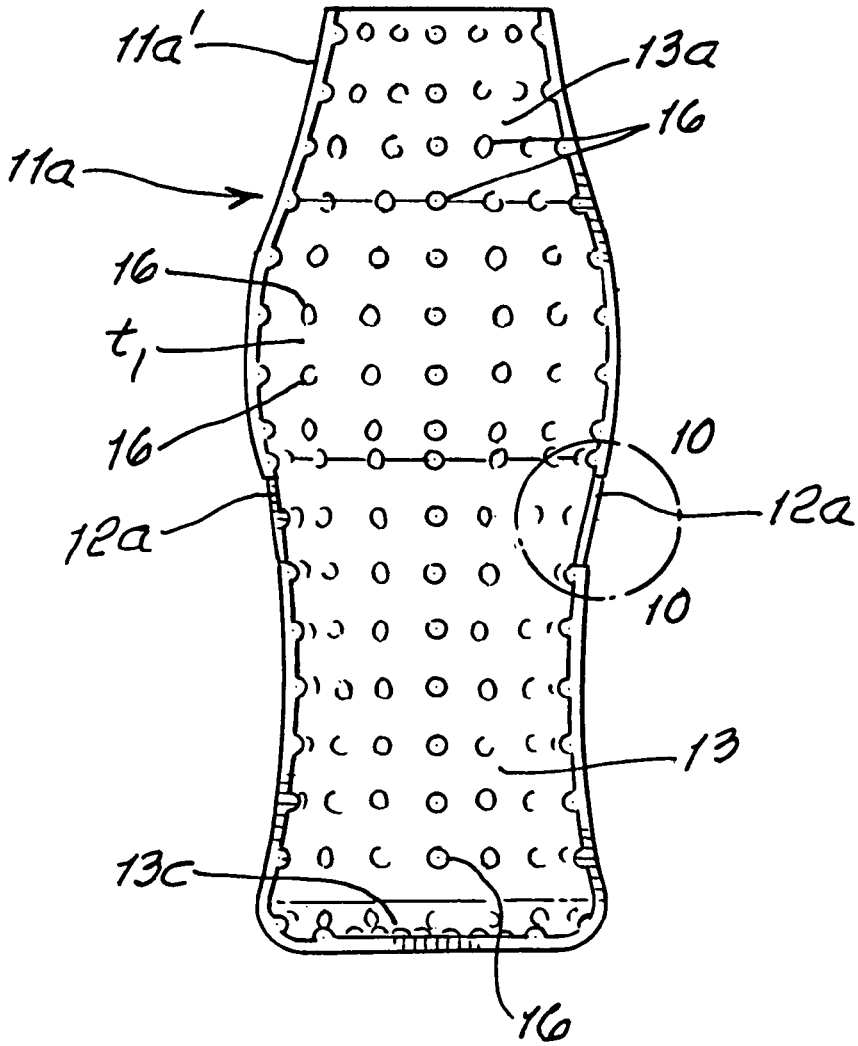
FIG. 9 is an elevation showing details of the FIG. 8 view.
Figure 10:
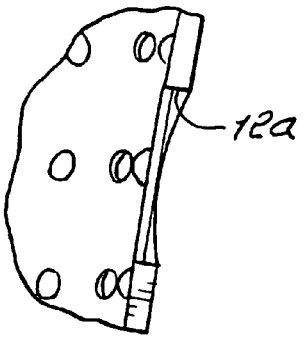
Figure 11:
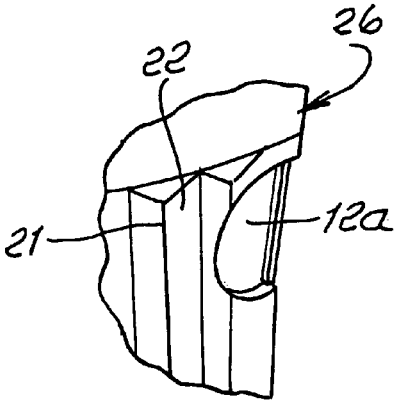
Figure 12:
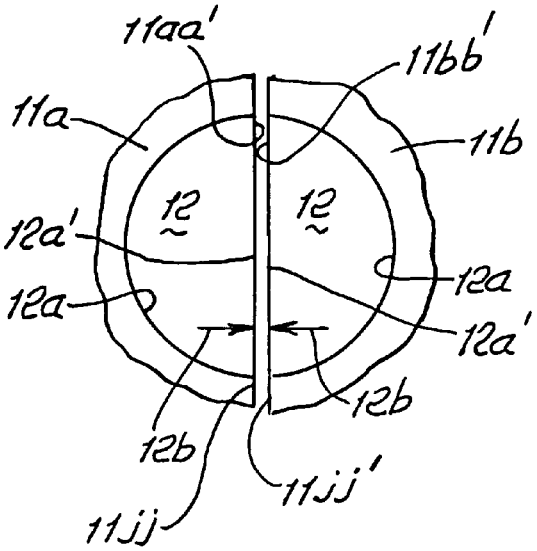
Figure 13:
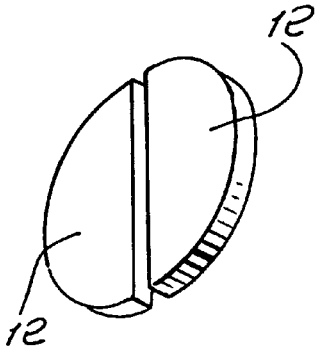
Figure 14:
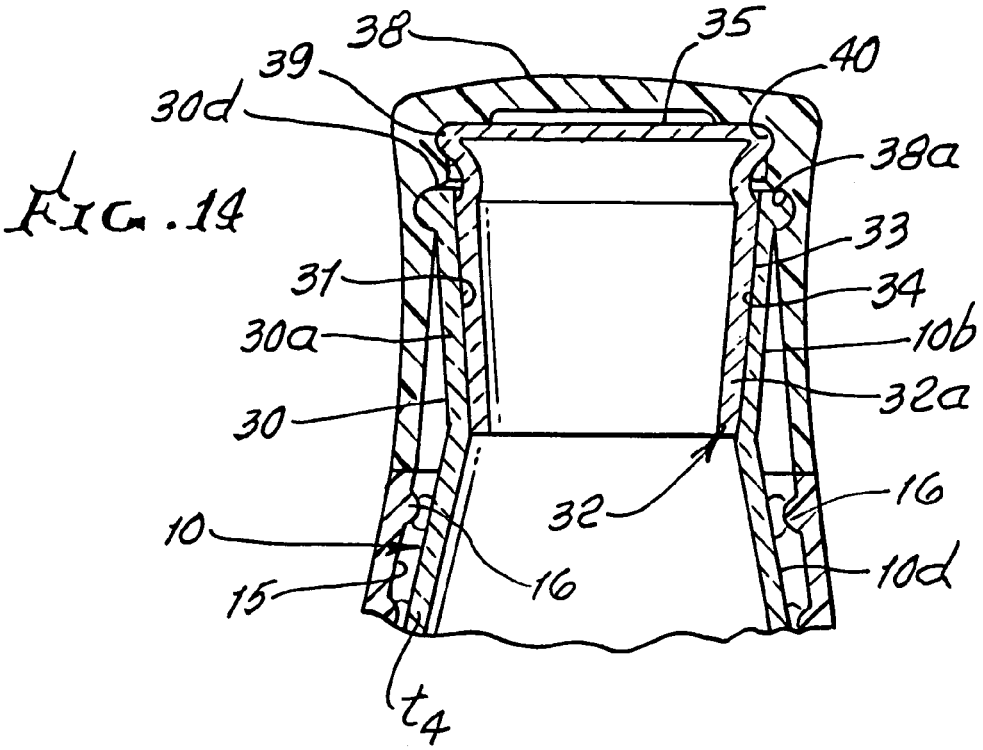
Figure 15:
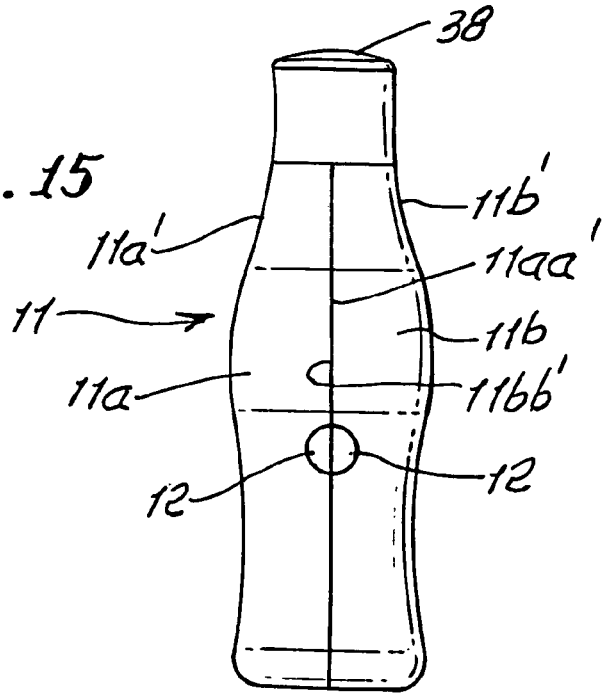

FIG. 10 a top plan view of cover section details taken on lines 10-10 of FIG. 9;

FIG. 11 is an enlarged fragmentary view taken on lines 11-11 of FIG. 7, and showing a magnet recess location;

FIG. 12 is an enlarged view showing two magnet elements in positions for holding cover sections assembled to a bottle;

FIG. 13 is a perspective view of the two magnet elements seen in FIG. 12, and in positions for holding cover sections assembled;

FIG. 14 is an enlarged section showing a stopper inserted into the bottle neck, and a cap extending over the stopper and bottle neck, is endwise alignment with the upper ends of the two cover tapered end portions; and FIG. 15 is a side elevation showing positioning of the two magnet elements protectively positioned below bulging of the two cover sections.

DETAILED DESCRIPTION

Referring first to FIGS. 1-6 and 14, they show a glass bottle 10 having an undulating wall 10*a* and an upwardly projecting glass neck 10*b*, which is upwardly divergent. Upwardly convergent glass shoulder 10*d*, extends between the top of wall 10*a*, and the lower extent of the neck 10*b*. Bottle bottom wall appears at 10*f*.

A cover 11 for the wall and neck includes two generally alike semi-cylindrical sections 11*a* and 11*b*, and having upwardly tapering shoulder portion 11*a*' and 11*b*'. Sections 11*a* and 11*b* are configured to edgewise fit together at and along edges 11*aa*' and 11*bb*' of walls 11*aa* and 11*bb*, and along edges 11*cc*' and 11*dd*' of shoulder portions 11*a*' 11*b*'. See also interfitting edges 11*ee*' and 11*ff*' of cover bottom wall sections 11*ee* and 11*ff*. Retention magnets 12 hold the sections 11*a* and 11*b* together the magnets fit in like, semicircular recesses 12*a* in those sections. See FIGS. 11, 12 and 15. Also see parallel straight edges 12*a*' of the magnets and retention force arrows 12*b*, in FIG. 12. Cover section edges 11*jj* and 11*jj*' are also shown.

Figure 2:
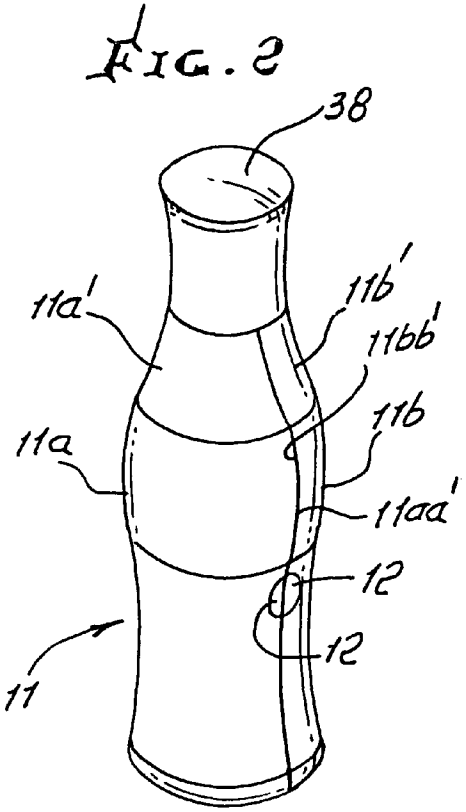
FIG. 2 is a perspective view showing the bottle cover in assembled state, about the bottle.
Figure 1:
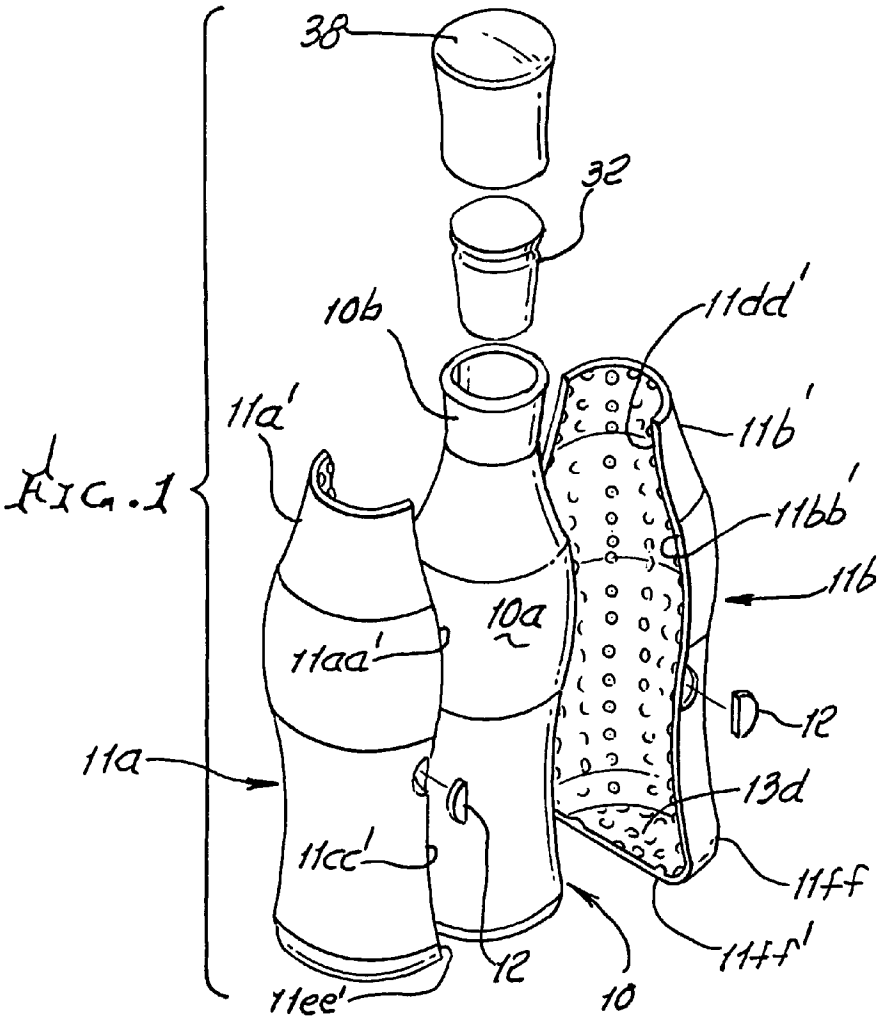
FIG. 1 is an exploded perspective view, showing one form of the invention.
Figure 5:
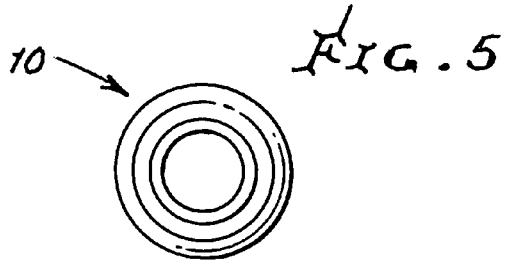
FIG. 5 is a top plan view taken on lines 5-5 of FIG. 3.
Figure 3:
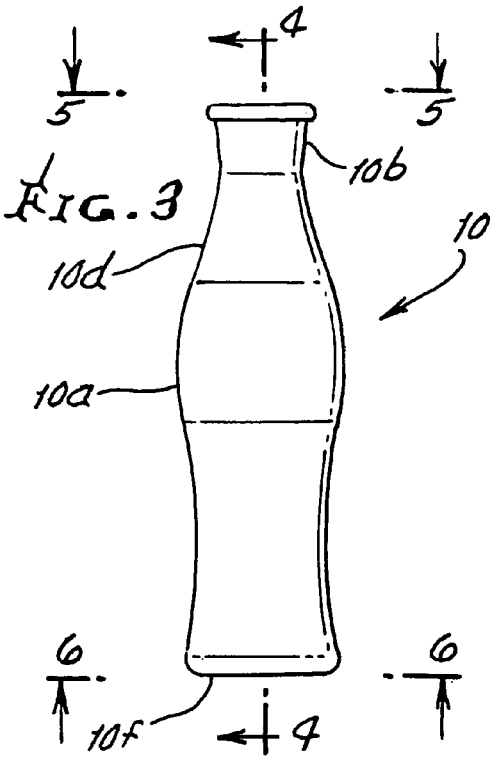
FIG. 3 is a side elevation view of the bottle.
Figure 4:
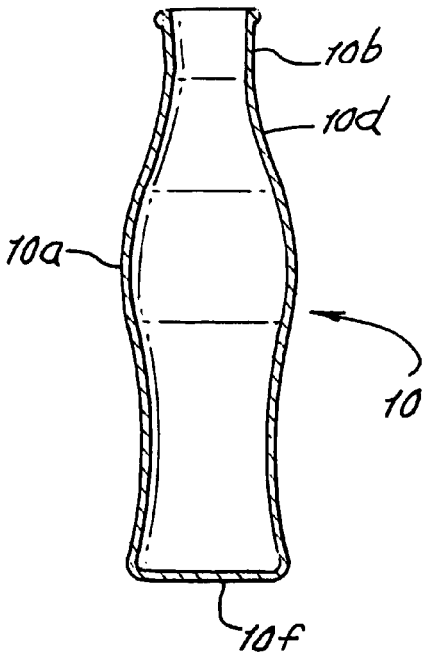
FIG. 4 is a vertical section taken on lines 4-4 of FIG. 3.
Figure 6:
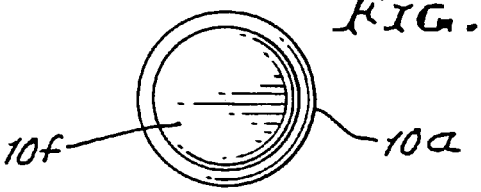
FIG. 6 is a bottom plan view taken on lines 6-6 of FIG. 5.
Figure 8:
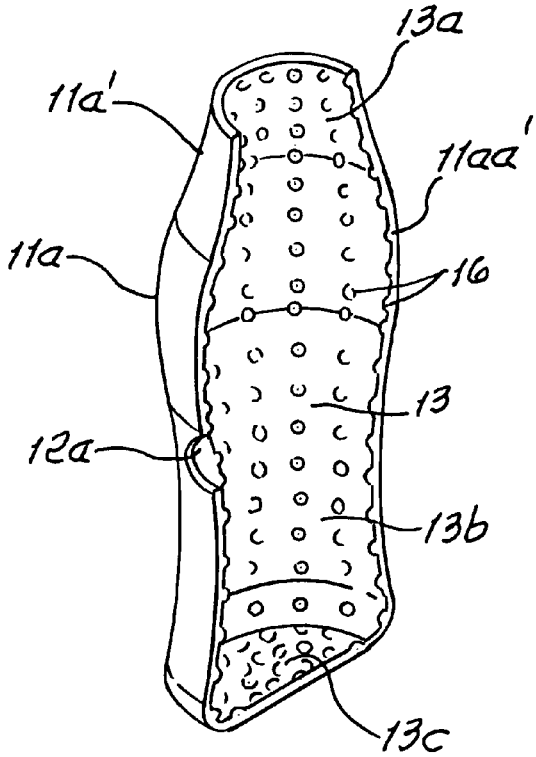
FIG. 8 is a perspective internal view of the FIG. 7 section.

The cover sections 11*a* and 11*b* typically and advantageously consists of thin walled, synthetic resin material, such as plastic polyurethane, molded to fit closely about the bottle, as is clear from FIGS. 1, 14 and 15. Each section defines an irregular inner surface, as at the inner surfaces 13 of the two sections 11*a* and 11*b*, and at inner surfaces 13*a* and 13*b* of the shoulder sections 11*a*' and 11*b*', and inner surfaces 13*c* and 13*d* of the bottom wall sections 11*cc* and 11*dd*. See also FIGS. 8 and 9 in this regard. The illustrated irregular surfaces are defined by shallow, recesses 15 in the described walls, as appear in FIG. 14. Protrusions 16 are formed by the cover walls, between the closely spaced recesses. Spacing $t_1$ is formed between protrusion.

Recess depths are preferably approximately equal to magnetic element thickness. These configurations are such as to facilitate compression and deflection of the irregular structure, to absorb or cushion impact loading and typically forces generated by bottle dropping onto flooring or equipment in a room, preventing breakage or shattering of the enclosed glass bottle, for example of dimensions illustrated. Note that the cover wall has overall thickness at $t_1$ approximity bottle wall thickness at $t_4$.

A modified glass bottle may have an irregular outer surface characterized by multiple elongated glass ribs. Such ribs 21 (see FIG. 11) are elongated and longitudinally parallel about the bottle, extending from near the bottom wall of the bottle to the upper shoulder of the bottle, that corresponds to shoulder sections 11*a*' and 11*b*' in FIG. 2. The ribs form flute shaped recesses 22 therebetween (see FIG. 11), so that the ribs taper toward their outermost extremities, enhancing capability for deflection, inwardly of the surrounding plastic cover 26 which compressively transmits impact loading of the ribs. This enhances impact shock resistance to prevent glass shattering.

Referring now to FIGS. 14 and 15, the bottle 10 has an upstanding, reduced diameter neck 30, forming a port 31. The port is removably plugged by a stopper 32 having an external tapered surface 33. That surface and the port surface have glass to glass annular sealing interengagement as at 34, formed by neck annular glass wall 30*a*, and stopper annular glass wall 32*a*. Also, the stopper has a glass inner top wall 35. Accordingly, fluid such as water in the bottle does not come in contact with plastic annular wall 38 covering the stopper upper extent, or the plastic of the bottle cover material.

The invention provides an impact resistant, plastic covered glass, re-usable and protected drinking water bottle.

FIG. 14 shows removable retention of the stopper glass wall 32*a* to the stopper plastic wall 38, as by an annular detent shown in the form of a glass bead 39, interfitting an annular recess 40 formed in wall 38. That wall 38 fits downwardly at 38*a* against the top 30*d* of the glass bottle neck, limiting the described glass-to-glass sealing engagement upon closure, and preventing jamming.

It will be understood that the cover sections 11*a* and 11*b* may be joined together as at locations of two lengthwise edges 11*aa*' and 11*bb*', so that only the remaining two cover sections edges 11*aa*' and 11*bb*' need to be held together by two magnets as seen in FIGS. 12 and 13.

1. Bottle is typically made to increases glass strength 200 to 300 percent.
2. Resilient plastic housing surrounding the bottle provides hemispherical indents which allow the plastic to give in, on impact, absorbing energy and preventing breakage.
3. Resilient plastic top holds machined glass water sealing insert.
4. Machined glass insert prevents water in glass bottle from touching anything but glass.
5. Snap on top provides resilient surface, preventing breakage.
6. Undulant glass bottle shape provides secure hand grip and typically fits automobile cup holder well.

I claim:

1. A high strength bottle and cover assembly comprising:

a) glass bottle, b) a synthetic resin cover extending closely about the bottle, the cover defining an irregular inner surface characterized in that surface deflection occurs upon impact with an external surface, preventing shattering of the glass, c) the bottle having a glass neck, d) a closure for said neck including a cylindrical glass lid engaging the neck, e) said closure including a synthetic resin cap endwise supporting said glass lid, the cap having a skirt extending about the lid and radially spaced therefrom, f) there being magnetic elements positioned for holding sections defined by the cover closed about the bottle, and in alignment with the closure, g) said elements having semi-circular shape, and are inset in like, semi-circular recesses formed in said sections, whereby parallel straight elongated edges formed by said magnetic elements closely oppose one another along the entire lengths of said edges when the cover sections extend closely about the bottle, and whereby said sections and magnets define a smooth non-irregular outer surface appearance, h) said sections having enlarged bulging extents crosswise of the bottle and below which the magnetic elements are carried.

2. The assembly of claim 1 wherein said magnetic elements are everywhere spaced from said cap skirt.

3. The assembly of claim 1 wherein the cover irregular inner surface forms multiple deflectable protrusions.

4. The assembly of claim 3 wherein said irregular inner surface defines protrusions which are distributed substantially uniformly over the majority of the cover inner surface.

5. The assembly of claim 1 wherein the bottle has an irregular outer surface engaged with the cover irregular inner surface.

6. The assembly of claim 1 wherein the bottle outer surface is characterized by an undulation lengthwise of the bottle, the bottle having a lower wall portion of reduced size relative to the bottle intermediate extent at said outward undulation.

7. The assembly of claim 1 wherein the bottle glass neck forms a port, the lid having an external surface, with glass to glass sealing interengagement with said neck.

8. The assembly of claim 7 wherein the cover extends into proximity to said neck, the closure fitting over the bottle neck, and removably and downwardly engaging said cover.

9. The assembly of claim 7 wherein the interior of the bottle is completely surrounded by glass surfaces formed by bottle interior walls and by the lid.

10. The assembly of claim 1 wherein the cover comprises two complementary sections that have interfitting edges allowing relative adjacent positioning of said sections, and toward and against the bottle exterior.

11. The assembly of claim 5 wherein said sections having endwise taper to fit endwise of a bottle cap retained to the bottle neck.

12. The assembly of claim 1 including an impact deflectable top extending over the end of the lid.

13. The assembly of claim 7 wherein said cap has ribbing forming local open zones into which ribbing is deflectable in response to impact loading against said cap.

14. The assembly of claim 1 wherein the cover has only two of said edge portions to be held in adjacent relation by said magnetic elements.

* * * * *